US007633514B2

(12) United States Patent
Asada

(10) Patent No.: US 7,633,514 B2
(45) Date of Patent: Dec. 15, 2009

(54) IMAGE GENERATING APPARATUS WITH INK SHEET CARTRIDGE EJECTION SUPPRESSION

(75) Inventor: Mitsuyasu Asada, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 505 days.

(21) Appl. No.: 11/513,215

(22) Filed: Aug. 31, 2006

(65) Prior Publication Data

US 2007/0052789 A1 Mar. 8, 2007

(30) Foreign Application Priority Data

Sep. 5, 2005 (JP) ..... 2005-255883

(51) Int. Cl.
*B41J 2/385* (2006.01)

(52) U.S. Cl. ..... 347/139

(58) Field of Classification Search ..... 347/139, 347/222, 220, 197; 400/224.2
See application file for complete search history.

(56) References Cited

U.S. PATENT DOCUMENTS 4,978,240 A * 12/1990 Katsuno ..... 400/224.2
2005/0062834 A1* 3/2005 Sawai ..... 347/220
2005/0225625 A1* 10/2005 Sawai ..... 347/220
2005/0276648 A1 12/2005 Sawai
2008/0192106 A1* 8/2008 Sawai et al. ..... 347/197

FOREIGN PATENT DOCUMENTS

| | | | |
|---|---|---|---|
| EP | 1 719 623 A2 | | 11/2006 |
| JP | 2-81661 A | | 3/1990 |
| JP | 5286198 | * | 11/1993 |
| JP | 11-268315 A | | 10/1999 |
| JP | 11268315 | * | 10/1999 |
| JP | 2001-38976 A | | 2/2001 |
| JP | 2003-89257 A | | 3/2003 |
| JP | 2003089257 | * | 3/2003 |

OTHER PUBLICATIONS

European Search Report dated Apr. 17, 2009.

* cited by examiner

*Primary Examiner*—Stephen D Meier
*Assistant Examiner*—Carlos A Martinez, Jr.
(74) *Attorney, Agent, or Firm*—Crowell & Moring LLP

(57) ABSTRACT

An image generating apparatus applicable to a structure employing an ink sheet cartridge having an outwardly exposed ink sheet, capable of suppressing ejection of the ink sheet cartridge in printing and capable of suppressing reduction of printing quality is obtained. This image generating apparatus comprises an ink sheet cartridge, a chassis, a first stop member provided outside the chassis for engaging with the ink sheet cartridge and a second stop member provided inside the chassis for engaging with the ink sheet cartridge in printing.

12 Claims, 10 Drawing Sheets

IMAGE GENERATING APPARATUS WITH INK SHEET CARTRIDGE EJECTION SUPPRESSION

BACKGROUND OF THE INVENTION

1. Field of the Invention

The present invention relates to an image generating apparatus, and more particularly, it relates to an image generating apparatus comprising an ink sheet cartridge.

2. Description of the Background Art

A thermal transfer printer comprising an ink sheet cartridge is known in general, as disclosed in Japanese Patent Laying-Open No. 2003-89257, for example.

The aforementioned Japanese Patent Laying-Open No. 2003-89257 describes the structure of a thermal transfer printer comprising an ink sheet cartridge, which can be easily ejected from a cartridge mount portion by sliding an ejection member (stop member). In this thermal transfer printer, a rib portion of the ink sheet cartridge is fitted with a stop portion provided on a print head mount. The ejection member is so slid that an inclined portion thereof urges a projection of the ink sheet cartridge in an ejective direction. Thus, the rib portion of the ink sheet cartridge escapes from the stop portion of the print head mount, so that the ink sheet cartridge is ejected. The ejection member can be slid not only in nonprinting, but also in printing.

A thermal transfer printer is generally known as an exemplary image generating apparatus. FIG. 19 is an overall perspective view of an exemplary conventional thermal transfer printer. FIG. 20 is a sectional view of the exemplary conventional thermal transfer printer shown in FIG. 19. The structure of the exemplary conventional thermal transfer printer is described with reference to FIGS. 19 and 20.

As shown in FIGS. 19 and 20, the conventional thermal transfer printer comprises a chassis 101 of metal, a print head 102 (see FIG. 20) for printing, a platen roller 103 (see FIG. 20) arranged oppositely to the print head 102, a feed roller 105 carrying a paper 104, a press roller 106 pressing the feed roller 105 and a stop member 107. An ink sheet cartridge 108 storing an ink sheet 108*a* for transferring ink to the paper 104 is mounted on the conventional thermal transfer printer. The chassis 101 has first and second side surfaces 101*a* and 101*b*, as shown in FIG. 19. A cartridge receiving hole 101*c* is provided on the second side surface 101*b* of the chassis 101 for receiving the ink sheet cartridge 108.

As shown in FIG. 19, the stop member 107 is provided outside the second side surface 101*b* of the chassis 101. This stop member 107 is provided with a support shaft 107*a* rotatably supporting the stop member 107, an engaging pawl 107*b* engaging with an engaging portion 108*g* of the ink sheet cartridge 108, a grip 107*c* held by a user for lifting the stop member 107 upward (along arrow B) and a spring portion 107*d* supplying urging force for rotating the engaging pawl 107*b* of the stop member 107 downward when the user lifts up the stop member 107 through the grip. The stop member 107 has a function of inhibiting the ink sheet cartridge 108 from moving in an ejective direction (along arrow A in FIG. 19).

As shown in FIG. 20, the ink sheet cartridge 108 includes a feed bobbin 108*b* for feeding the ink sheet 108*a* and a take-up bobbin 108*c* for taking up the fed ink sheet 108*a*. A cartridge case forming the ink sheet cartridge 108 is constituted of a feed bobbin storage portion 108*d* rotatably storing the feed bobbin 108*b*, a take-up bobbin storage portion 108*e* rotatably storing the take-up bobbin 108*c* and a pair of coupling portions 108*f* coupling the feed bobbin storage portion 108*d* and the take-up bobbin storage portion 108*e* with each other at a prescribed distance. When the feed bobbin storage portion 108*d* and the take-up bobbin storage portion 108*e* store the feed bobbin 180*b* and the take-up bobbin 108*c* respectively, therefore, the ink sheet 108*a* wound on the feed bobbin 180*b* and the take-up bobbin 108*c* is outwardly exposed on the space of the prescribed distance between the feed bobbin storage portion 108*d* and the take-up bobbin storage portion 108*e*. The engaging portion 108*g* (see FIG. 19) engaging with the engaging pawl 107*b* of the stop member 107 provided on the second side surface 101*b* of the chassis 101 is provided on one of the pair of coupling portions 108*f*. The ink sheet cartridge 108 is provided with a helical compression spring (not shown), which regularly urges the ink sheet cartridge 108 mounted on the thermal transfer printer along arrow A in FIG. 19.

As shown in FIG. 20, the print head 102 has a support shaft 102*a* forming the rotation center of the print head 102, a head portion 102*b*, an arm portion 102*c* and a heat sink portion 102*d* for radiating heat from the head portion 102*b*. As shown in FIG. 20, further, the print head 102 is mounted on the first and second side surfaces 101*a* and 101*b* of the chassis 101 to be rotatable about the support shaft 102*a*.

A printing operation of the conventional thermal transfer printer is described with reference to FIG. 20. When the print head 102 rotates along arrow C, the head portion 102*b* thereof comes into contact with the ink sheet 108*a* outwardly exposed from the ink sheet cartridge 108, as shown in FIG. 20. When the print head 102 further rotates, the ink sheet 108*a* comes into contact with the fed paper 104. The head portion 102*b* of the print head 102 and the platen roller 103 press the ink sheet 108*a* and the paper 104. In this state, the take-up bobbin 108*c* takes up the ink sheet 108*a*, while the feed roller 105 carries the paper 104 in a paper discharge direction (along arrow D in FIG. 20). At this time, the head portion 102*b* of the print head 102 generates heat, to melt the ink of the ink sheet 108*a*. Thus, the ink is transferred from the ink sheet 108*a* to the paper 104, for printing an image on the paper 104.

An operation of ejecting the ink sheet cartridge 108 from the conventional thermal transfer printer is described with reference to FIG. 19. When the ink sheet cartridge 108 is mounted on the thermal transfer printer, the engaging portion 108*g* of the ink sheet cartridge 108 and the engaging pawl 107*b* of the stop member 107 engage with each other, as shown in FIG. 19. The helical compression spring (not shown) regularly urges the ink sheet cartridge 108 along arrow A. When the user lifts the stop member 107 upward (along arrow B) through the grip 107*c*, the engaging portion 108*g* of the ink sheet cartridge 108 and the engaging pawl 107*b* of the stop member 107 disengage from each other. Thus, the ink sheet cartridge 108 jumps out of the thermal transfer printer along arrow A in FIG. 19, due to the urging force of the helical compression spring (not shown). Thereafter the user ejects the ink sheet cartridge 108 by manually extracting the same from the ink sheet cartridge receiving hole 101*c* of the chassis 101.

In the conventional thermal transfer printer shown in FIGS. 19 and 20, however, the user can eject the ink sheet cartridge 108 as described above also in printing since the stop member 107 for ejecting the ink sheet cartridge 108 is provided outside the second side surface 101*b* of the chassis 101. If the user accidentally ejects the ink sheet cartridge 108 during the aforementioned printing operation, therefore, the ink sheet 108*a* pressed by the head portion 102*b* of the print head 102 and the platen roller 103 may be broken, or the ink sheet 108*a* may be entangled in the thermal transfer printer to cause a failure in the thermal transfer printer.

In the thermal transfer printer described in the aforementioned Japanese Patent Laying-Open No. 2003-89257, the ejection member for ejecting the ink sheet cartridge is sidable not only in nonprinting but also in printing. If the user accidentally slides the ejection member in printing, therefore, the ink sheet may be broken, or may be entangled in the thermal transfer printer to cause a failure in the thermal transfer printer.

In this regard, various thermal transfer printers capable of suppressing ejection of ink sheet cartridges in printing are proposed in general, as disclosed in Japanese Patent Laying-Open Nos. 2001-38976, 11-268315 (1999) and 2-81661 (1990), for example.

The aforementioned Japanese Patent Laying-Open No. 2001-38976 proposes a thermal transfer printer, comprising an ink sheet cartridge, capable of suppressing ejection of the ink sheet cartridge in printing. In this thermal transfer printer, a projecting portion is provided on a free end of a cantilevered print head mount. The print head mount is provided with a print head, which is pressed by a platen roller in printing so that the print head mount is deflected to move the free end. Thus, the projecting portion of the print head mount engages with an end surface of the ink sheet cartridge, for suppressing ejection of the ink sheet cartridge. The ink sheet cartridge is provided with a grab, so that the user ejects the ink sheet cartridge by pulling this grab.

The aforementioned Japanese Patent Laying-Open No. 11-268315 proposes a thermal transfer printer, comprising an ink sheet cartridge, having a cartridge ejection preventing portion provided on a rotating arm rotating a print head. In this thermal transfer printer, the cartridge ejection preventing portion engages with a cartridge engaging member suppressing ejection of the ink sheet cartridge following rotation of the print head. Thus, thermal transfer printer can so inhibit the cartridge engaging member from rotation that it is difficult for the user to rotate the same, whereby the thermal transfer printer can suppress ejection of the ink sheet cartridge in printing. When the user operates the cartridge engaging member engaging with the cartridge ejection preventing portion in the thermal transfer printer proposed in Japanese Patent Laying-Open No. 11-268315, urging force is applied to the rotating arm.

The aforementioned Japanese Patent Laying-Open No. 2-81661 proposes a thermal transfer printer, provided with an ink sheet cartridge having an unexposed ink sheet, capable of suppressing ejection of the ink sheet cartridge through engagement of an engaging portion rotating following rotation of a loading arm for ejecting a take-up bobbin from a cartridge case for outwardly exposing the ink sheet with a notch provided on the ink sheet cartridge. In this thermal transfer printer, the loading arm ejects the take-up bobbin from the ink sheet cartridge in printing, thereby suppressing ejection of the ink sheet cartridge during the printing.

In the thermal transfer printer proposed in the aforementioned Japanese Patent Laying-Open No. 2001-38976, however, urging force is disadvantageously applied to the print head mount engaging with the end surface of the ink sheet cartridge when the user pulls the grab of the ink sheet cartridge in printing. Therefore, the position of the print head provided on the print head mount deviates in printing, to disadvantageously reduce printing quality.

In the thermal transfer printer proposed in the aforementioned Japanese Patent Laying-Open No. 11-268315, urging force is disadvantageously applied to the rotating arm through the cartridge ejection preventing portion when the user operates the cartridge engaging member in printing. Therefore, the position of the print head deviates in printing to reduce printing quality, similarly to the aforementioned Japanese Patent Laying-Open No. 2001-38976.

The thermal transfer printer proposed in the aforementioned Japanese Patent Laying-Open No. 2-81661, provided with the engaging portion engaging with the notch of the ink sheet cartridge and rotating following rotation of the loading arm ejecting the take-up bobbin from the cartridge, presupposes the structure having the loading arm for ejecting the take-up bobbin from the cartridge case. Therefore, it is disadvantageously difficult to apply the structure of the thermal transfer printer proposed in the aforementioned Japanese Patent Laying-Open No. 2-81661 to a thermal transfer printer employing an ink sheet cartridge having a regularly outwardly exposed ink sheet, from which no take-up bobbin may be ejected.

SUMMARY OF THE INVENTION

The present invention has been proposed in order to solve the aforementioned problems, and an object of the present invention is to provide an image generating apparatus applicable to a structure employing an ink sheet cartridge having an outwardly exposed ink sheet, capable of suppressing ejection of the ink sheet cartridge in printing and capable of suppressing reduction of printing quality.

In order to attain the aforementioned object, an image generating apparatus according to a first aspect of the present invention comprises an ink sheet cartridge including a cartridge case provided with a feed bobbin storage portion and a take-up bobbin storage portion coupled with each other through a pair of coupling portions at a prescribed interval, a feed bobbin and a take-up bobbin stored in the cartridge case and an ink sheet outwardly exposed between the feed bobbin storage portion and the take-up bobbin storage portion, a chassis mounted with the ink sheet cartridge, a first stop member provided outside the chassis for engaging with the ink sheet cartridge and a second stop member provided inside the chassis for engaging with the ink sheet cartridge in printing.

The image generating apparatus according to the first aspect, comprising the cartridge case provided with the feed bobbin storage portion and the take-up bobbin storage portion coupled with each other through the pair of coupling portions at the prescribed interval, the feed bobbin and the take-up bobbin stored in the cartridge case and the ink sheet outwardly exposed between the feed bobbin storage portion and the take-up bobbin storage portion as hereinabove described, has the first stop member provided outside the chassis and the second stop member provided inside the chassis for engaging with the ink sheet cartridge in printing so that the same can suppress ejection of the ink sheet cartridge in printing due to engagement between the second stop member and the ink sheet cartridge in the chassis, also when a user disengages the first stop member provided outside the chassis and the ink sheet cartridge from each other in printing. Consequently, the image generating apparatus can suppress breakage of the ink sheet, and can prevent a failure resulting from entanglement of the ink sheet therein. Further, the image generating apparatus comprising the ink sheet cartridge including the outwardly exposed ink sheet is so formed with the second stop member provided inside the chassis that the user can be inhibited from touching the second stop member, whereby the second stop member can be prevented from application of a load in printing. Thus, the image generating apparatus can prevent members provided inside the chassis from application of a load in printing, thereby suppressing reduction of printing quality.

The aforementioned image generating apparatus according to the first aspect preferably further comprises a print head for printing, a platen roller arranged on a position opposite to the print head and a press member pressing the print head against the platen roller, and the second stop member is preferably mounted on a rotating shaft of the press member. According to this structure, the image generating apparatus can rotate the second stop member following rotation of the press member rotating the print head in printing, whereby the second stop member can engage with the ink sheet cartridge in printing without a dedicated drive source. Consequently, the image generating apparatus can easily suppress ejection of the ink sheet cartridge in printing.

In the aforementioned image generating apparatus comprising the print head, the platen roller and the press member, the second stop member is preferably unidly mounted with respect to the rotating shaft. According to this structure, the second stop member can unidly rotate with respect to the rotating shaft of the press member rotating the print head in printing following rotation of the rotating shaft, whereby the second stop member can easily engage with the ink sheet cartridge in printing.

In this case, an oval stop member insert portion is preferably provided on a portion of the rotating shaft mounted with the second stop member, and an oval rotating shaft receiving hole is preferably provided on a portion of the second stop member receiving the rotating shaft. According to this structure, the second stop member can be easily unidly mounted with respect to the rotating shaft by inserting the oval stop member insert portion of the rotating shaft into the oval rotating shaft receiving hole of the second stop member.

In the aforementioned image generating apparatus according to the first aspect, the ink sheet cartridge is preferably provided with an engaging portion engaging with the second stop member. According to this structure, the second stop member can easily engage with the engaging portion of the ink sheet cartridge, thereby easily suppressing ejection of the ink sheet cartridge.

In the aforementioned image generating apparatus having the ink sheet cartridge provided with the engaging portion engaging with the second stop member, the engaging portion of the ink sheet cartridge preferably includes a groove portion engaging with both surfaces of the second stop member. According to this structure, the image generating apparatus can inhibit the ink sheet cartridge from movement not only in an ejective direction but also in a direction opposite thereto. Thus, the image generating apparatus can suppress reduction of printing quality resulting from misregistration in the direction opposite to the ejective direction for the ink sheet.

In the aforementioned image generating apparatus having the ink sheet cartridge provided with the engaging portion including the groove portion engaging with both surfaces of the second stop member, the ink sheet cartridge preferably further includes a multicolor ink sheet, and the second stop member preferably rotates following rotation of the print head and engages with the groove portion while the print head vertically rotates for printing the multicolor ink sheet. According to this structure, the image generating apparatus can suppress ejection of the ink sheet cartridge also when the user disengages the first stop member and the ink sheet cartridge from each other while the print head separates from the platen roller upon completion of printing in each color. Thus, the image generating apparatus can suppress imperfect completion of printing resulting from ejection of the ink sheet cartridge in an intermediate stage of printing in each color.

In this case, the groove portion preferably has a slender shape. According to this structure, the image generating apparatus can so increase the area of the groove portion engaging with the second stop member as to inhibit the second stop member from disengaging from the slender groove portion when the print head rotates to separate from the platen roller upon completion of printing in each color. Thus, the second stop member can easily engage with the groove portion also when the print head separates from the platen roller upon completion of printing in each color.

In the aforementioned image generating apparatus having the ink sheet cartridge provided with the engaging portion including the groove portion engaging with both surfaces of the second stop member, the groove portion is preferably provided on either coupling portion of the ink sheet cartridge. According to this structure, the groove portion is so located around a central portion between the take-up bobbin storage portion and the feed bobbin storage portion that the second stop member can engage with the groove portion around the central portion between the take-up bobbin storage portion and the feed bobbin storage portion. Therefore, the second stop member can inhibit the ink sheet cartridge from movement around the central portion between the take-up bobbin storage portion and the feed bobbin storage portion of the ink sheet cartridge, whereby the image generating apparatus can more stably inhibit the ink sheet cartridge from movement as compared with a case of inhibiting the ink sheet cartridge from movement on the side of the feed bobbin storage portion or the take-up bobbin storage portion.

In the aforementioned image generating apparatus having the ink sheet cartridge provided with the engaging portion engaging with the second stop member, a portion of the second stop member engaging with the engaging portion of the ink sheet cartridge is preferably arcuately formed. According to this structure, the second stop member can so easily partially engage with the engaging portion that the image generating apparatus can easily keep the second stop member and the engaging portion in engagement also when the print head vertically rotates in printing.

An image generating apparatus according to a second aspect comprises an ink sheet cartridge including a cartridge case provided with a feed bobbin storage portion and a take-up bobbin storage portion coupled with each other through a pair of coupling portions at a prescribed interval, a feed bobbin and a take-up bobbin stored in the cartridge case and a multicolor ink sheet outwardly exposed between the feed bobbin storage portion and the take-up bobbin storage portion, a chassis mounted with the ink sheet cartridge, a print head for printing, a platen roller arranged on a position opposite to the print head, a press member pressing the print head against the platen roller, a first stop member provided outside the chassis for engaging with the ink sheet cartridge and a second stop member provided inside the chassis for engaging with the ink sheet cartridge in printing, the ink sheet cartridge is provided with a groove portion engaging with both surfaces of the second stop member, the groove portion is provided on either coupling portion of the ink sheet cartridge, the second stop member is mounted on a rotating shaft of the press member for rotating following rotation of the print head and engaging with the groove portion while the print head vertically rotates for printing the multicolor ink sheet, and a portion of the second stop member engaging with the ink sheet cartridge is arcuately formed.

The image generating apparatus according to the second aspect, comprising the cartridge case provided with the feed bobbin storage portion and the take-up bobbin storage portion coupled with each other through the pair of coupling portions at the prescribed interval, the feed bobbin and the take-up bobbin stored in the cartridge case and the ink sheet outwardly exposed between the feed bobbin storage portion and the take-up bobbin storage portion as hereinabove described, has the first stop member provided outside the chassis and the second stop member provided inside the chassis for engaging with the ink sheet cartridge in printing so that the same can suppress ejection of the ink sheet cartridge in printing due to engagement between the second stop member and the ink sheet cartridge in the chassis, also when a user disengages the first stop member provided outside the chassis and the ink sheet cartridge from each other in printing. Consequently, the image generating apparatus can suppress breakage of the ink sheet, and can prevent a failure resulting from entanglement of the ink sheet therein. Further, the image generating apparatus comprising the ink sheet cartridge including the outwardly exposed ink sheet is so formed with the second stop member provided inside the chassis that the user can be inhibited from touching the second stop member, whereby the second stop member can be prevented from application of a load in printing. Thus, the image generating apparatus can prevent members provided inside the chassis from application of a load in printing, thereby suppressing reduction of printing quality. In addition, the image generating apparatus can rotate the second stop member following rotation of the press member rotating the print head in printing, whereby the second stop member can engage with the ink sheet cartridge in printing without a dedicated drive source. Consequently, the image generating apparatus can easily suppress ejection of the ink sheet cartridge in printing.

According to the second aspect, further, the image generating apparatus, having the ink sheet cartridge provided with the groove portion engaging with both surfaces of the second stop member, can inhibit the ink sheet cartridge from movement not only in an ejective direction but also in a direction opposite thereto. Thus, the image generating apparatus can suppress reduction of printing quality resulting from misregistration in the direction opposite to the ejective direction for the ink sheet. In addition, the second stop member rotates following rotation of the print head and engages with the groove portion while the print head vertically rotates for printing the multicolor ink sheet, whereby the image generating apparatus can suppress ejection of the ink sheet cartridge also when the user disengages the first stop member and the ink sheet cartridge from each other while the print head separates from the platen roller upon completion of printing in each color. Thus, the image generating apparatus can suppress imperfect completion of printing resulting from ejection of the ink sheet cartridge in an intermediate stage of printing in each color. Further, the groove portion, provided on either coupling portion of the ink sheet cartridge, is so located around a central portion between the take-up bobbin storage portion and the feed bobbin storage portion that the second stop member can engage with the groove portion around the central portion between the take-up bobbin storage portion and the feed bobbin storage portion. Therefore, the second stop member can inhibit the ink sheet cartridge from movement around the central portion between the take-up bobbin storage portion and the feed bobbin storage portion of the ink sheet cartridge, whereby the image generating apparatus can more stably inhibit the ink sheet cartridge from movement as compared with a case of inhibiting the ink sheet cartridge from movement on the side of the feed bobbin storage portion or the take-up bobbin storage portion. Further, the portion of the second stop member engaging with the ink sheet cartridge is arcuately formed, whereby the second stop member can so easily partially engage with the groove portion that the image generating apparatus can easily keep the second stop member and the groove portion in engagement also when the print head vertically rotates in printing.

In the aforementioned image generating apparatus according to the second aspect, the second stop member is preferably unidly mounted with respect to the rotating shaft. According to this structure, the second stop member can unidly rotate with respect to the rotating shaft of the press member rotating the print head in printing following rotation of the rotating shaft, so that the second stop member can easily engage with the ink sheet cartridge in printing.

In this case, an oval stop member insert portion is preferably provided on a portion of the rotating shaft mounted with the second stop member, and an oval rotating shaft receiving hole is preferably provided on a portion of the second stop member receiving the rotating shaft. According to this structure, the second stop member can be easily unidly mounted with respect to the rotating shaft by inserting the oval stop member insert portion of the rotating shaft into the oval rotating shaft receiving hole of the second stop member.

In the aforementioned image generating apparatus according to the second aspect, the groove portion preferably has a slender shape. According to this structure, the image generating apparatus can so increase the area of the groove portion engaging with the second stop member as to inhibit the second stop member from disengaging from the slender groove portion when the print head rotates to separate from the platen roller upon completion of printing in each color. Thus, the second stop member can easily engage with the groove portion also when the print head separates from the platen roller upon completion of printing in each color.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
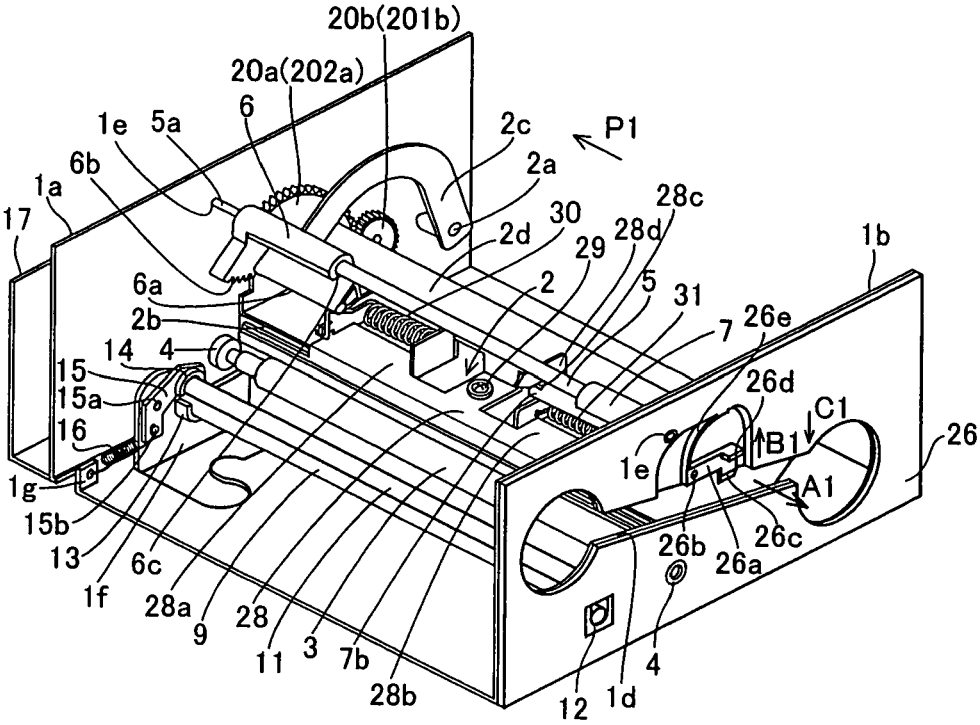
FIG. 1 is a perspective view showing the overall structure of a thermal transfer printer according to an embodiment of the present invention.

An embodiment of the present invention is now described with reference to the drawings.

The structure of a thermal transfer printer according to this embodiment is described with reference to FIGS. 1 to 13. According to this embodiment, the present invention is applied to the thermal transfer printer, which is an exemplary image generating apparatus.

As shown in FIGS. 1 to 4 and 13, the thermal transfer printer according to this embodiment comprises a chassis 1 of metal, a print head 2 for printing, a platen roller 3 arranged oppositely to the print head 2, two platen roller bearings 4 rotatably supporting the platen roller 3, a support rod 5 of metal, head portion press members 6 and 7 for pressing the print head 2, a feed roller 9 of metal for carrying a paper 8 (see FIG. 13), a feed roller gear 10 (see FIG. 4), a press roller 11 of metal pressing the feed roller 9 with prescribed pressing force, feed roller bearings 12 and 13 rotatably supporting the feed roller 9, press roller bearings 14 rotatably supporting the press roller 11, bearing support plates 15, helical tension springs 16 for urging the press roller 11 with pressing force, a motor bracket 17, a paper feed motor 18 (see FIG. 4) for driving the feed roller 9 etc., a motor gear 18*a* (see FIG. 4), a press member rotating motor 19 (see FIG. 4) for driving the head portion press members 6 and 7, a drive gear 20*a*, an intermediate gear 20*b*, a swing gear 21 (see FIG. 4), intermediate gears 22 and 23 (see FIG. 4) and a take-up reel 24. An ink sheet cartridge 25 (see FIG. 3) of resin storing ink sheets 25*a* is mounted on the thermal transfer printer according to this embodiment. The support rod 5 is an example of the "rotating shaft" in the present invention, and the head portion press members 6 and 7 are examples of the "press member" in the present invention.

As shown in FIG. 1, the chassis 1 has first and second side surfaces 1*a* and 1*b* and a bottom surface 1*c*. The aforementioned motor bracket 17 is mounted on the first side surface 1*a* of the chassis 1*a*. A cartridge receiving hole 1*d* for receiving the ink sheet cartridge 25 is provided on the second side surface 1*b* of the chassis 1 opposed to the first side surface 1*a*. The feed roller bearing 12 supporting a first end of the feed roller 9 is also provided on the second side surface 1*b* of the chassis 1. Further, a side plate 26 integrally provided with a stop portion 26*a* for inhibiting the ink sheet cartridge 25 from moving in an ejective direction (along arrow A1 in FIG. 1) is mounted outside the second side surface 1*b* of the chassis 1. The stop portion 26*a* is provided with a support shaft 26*b* rotatably supporting the stop portion 26*a*, an engaging pawl 26*c* engaging with an engaging portion 25*h* of the ink sheet cartridge 25, a grip 26*d* held by a user for lifting the stop portion 26*a* upward (along arrow B1) and a spring portion 26*e* supplying urging force for rotating the engaging pawl 26*c* of the stop portion 26*a* downward (along arrow C1) when the user lifts up the stop portion 26*a* through the grip 26*d*. The stop portion 26*a* is so formed that the user can eject the ink sheet cartridge 25 by lifting up the stop portion 26*a* through the grip 26*d*. The stop portion 26*a* is an example of the "first stop member" in the present invention. Support holes 1*e* are provided on the first and second side surfaces 1*a* and 1*b* of the chassis 1 respectively, for rotatably supporting the support rod 5 mounted with the head portion press members 6 and 7. A bent section if is provided on the bottom surface 1*c* of the chassis 1 by partially uprighting the bottom surface 1*c*. The feed roller bearing 13 supporting a second end of the feed roller 9 is provided on this bent section 1*f*, as shown in FIG. 1. A spring mount portion 1*g* mounted with a first end of the helical tension spring 16 is provided on the bottom surface 1*c* of the chassis 1, as shown in FIG. 1.

Figure 7:
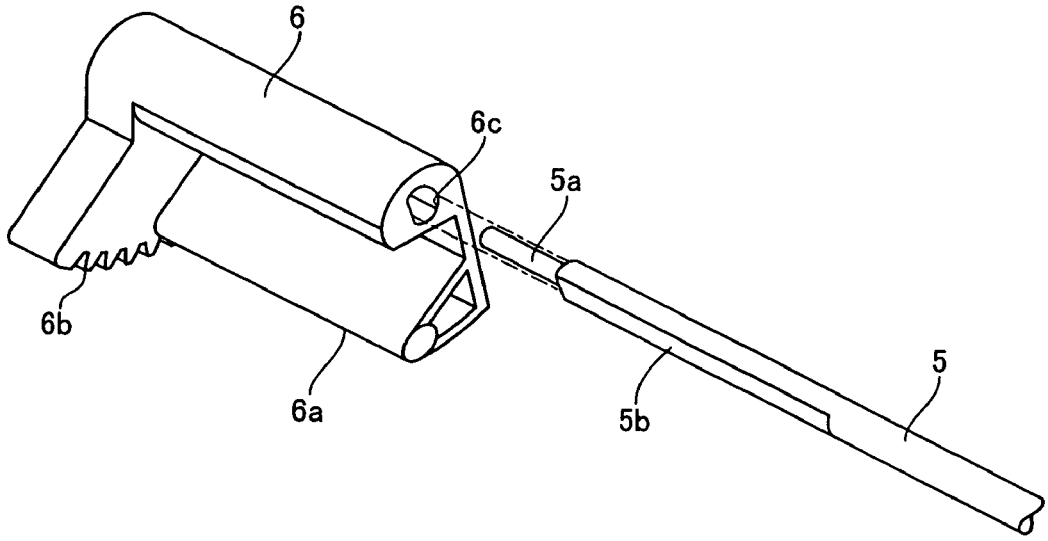
FIGS. 7 and 8 are perspective views showing the structure of a head press member of the thermal transfer printer according to the embodiment shown in FIG. 1.
Figure 8:
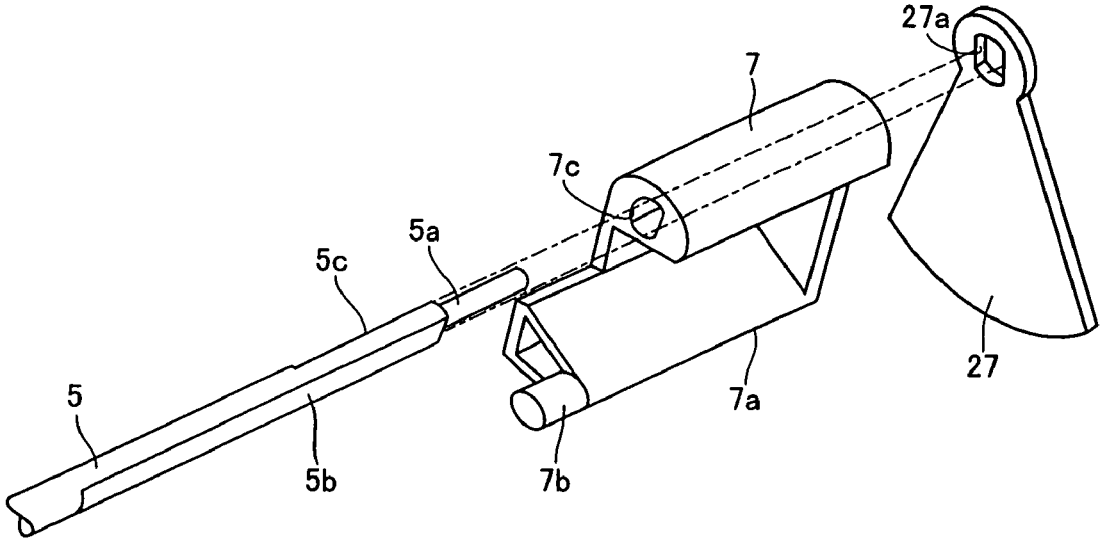

As shown in FIGS. 7 and 8, first and second support portions 5*a* are provided on first and second ends of the support portion 5 respectively. The first and second support portions 5*a* of the support rod 5 are fitted into the support holes 1*e* provided on the first and second side surfaces 1*a* and 1*b* of the chassis 1 respectively. As shown in FIGS. 7 and 8, further, the head portion press members 6 and 7 are mounted on the first and second ends of the support rod 5 respectively, unidly with respect to the support rod 5. More specifically, D-shaped insert portions 5*b* are provided in the vicinity of both ends of the support rod 5 respectively, as shown in FIGS. 7 and 8. An oval stop member insert portion 5*c* press-fitted into a stop member 27 is provided on the second end of the support rod 5.

As shown in FIG. 7, the head portion press member 6 is integrally formed with a press portion 6*a* and a gear portion 6*b*. As shown in FIG. 8, the head portion press member 7 is integrally formed with a press portion 7*a* and a projection 7*b* protruding in the extensional direction of the support rod 5.

The head portion press members 6 and 7 are formed with D-shaped receiving holes 6*c* and 7*c* receiving the insert portions 5*b* provided in the vicinity of both ends of the support rod 5 respectively. Upon rotation of the head portion press member 6, therefore, the support rod 5 rotates, followed by rotation of the head portion press member 7. The head portion press members 6 and 7 are arranged on the sides of the first and second side surfaces 1*a* and 1*b* of the chassis 1 respectively, as shown in FIGS. 1 and 2.

Figure 6:
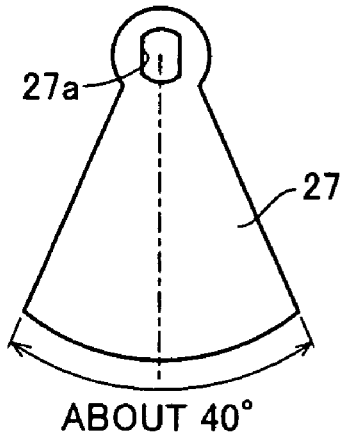
FIG. 6 is a front elevational view showing a stop member of the thermal transfer printer according to the embodiment shown in FIG. 1.

According to this embodiment, the stop member 27 of resin is mounted on the second end of the support rod 5. A portion of the stop member 27 engaging with the ink sheet cartridge 25 is arcuately formed, as shown in FIG. 6. The arcuately formed portion of the stop member 27 has an angle of about 40°. Further, the stop member 27 is provided with an oval support rod receiving hole 27*a*, into which the support rod 5 is press-fitted. The stop member 27 is unidly mounted on the support rod 5. Upon rotation of the head portion press members 6 and 7, therefore, the stop member 27 rotates in association with the head portion press members 6 and 7. The stop member 27 is provided inside the second side surface 1*b* of the chassis 1, so that the user cannot touch the same. The stop member 27 is an example of the "second stop member" in the present invention, and the support rod receiving hole 27*a* is an example of the "rotating shaft receiving hole" in the present invention.

Figure 13:
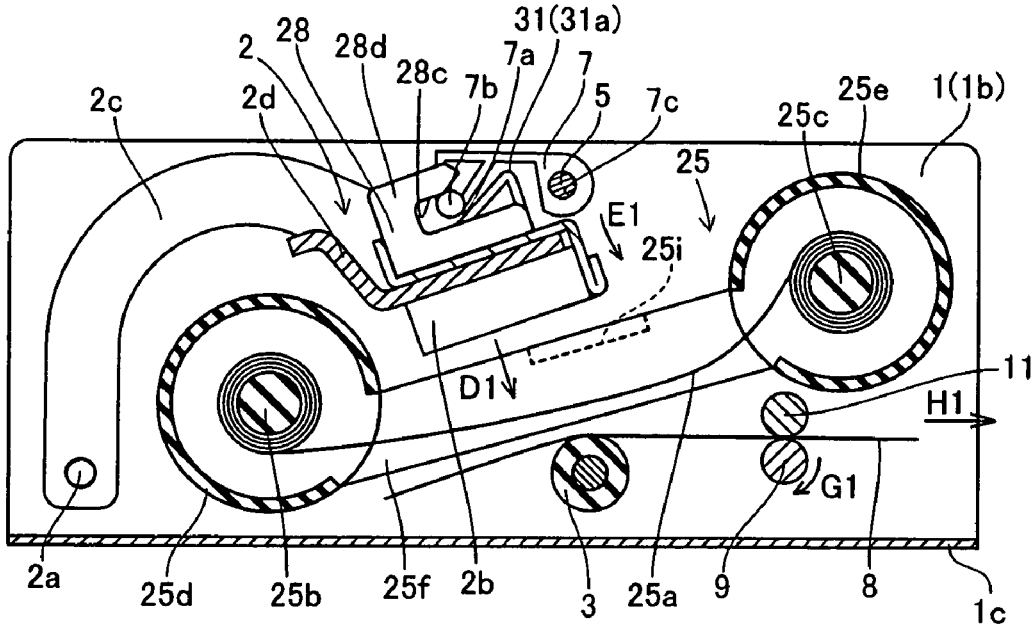
FIG. 13 is a sectional view showing the internal structure of the thermal transfer printer according to the embodiment shown in FIG. 1.

As shown in FIGS. 1 and 13, the print head 2 has a pair of support shafts 2*a*, a head portion 2*b* (see FIG. 13), a pair of arm portions 2*c* coupling the support shafts 2*a* and the head portion 2*b* with each other and a heat sink portion 2*d* of aluminum for radiating heat from the head portion 2*b*. The pair of support shafts 2*a* of the print head 2 are vertically rotatably mounted on the inner surfaces of the first and second side surfaces 1*a* and 1*b* of the chassis 1 respectively. The platen roller 3 is rotatably supported by the two platen roller bearings 4 (see FIG. 1) mounted on the first and second side surfaces 1*a* and 1*b* of the chassis 1 respectively.

Figure 2:
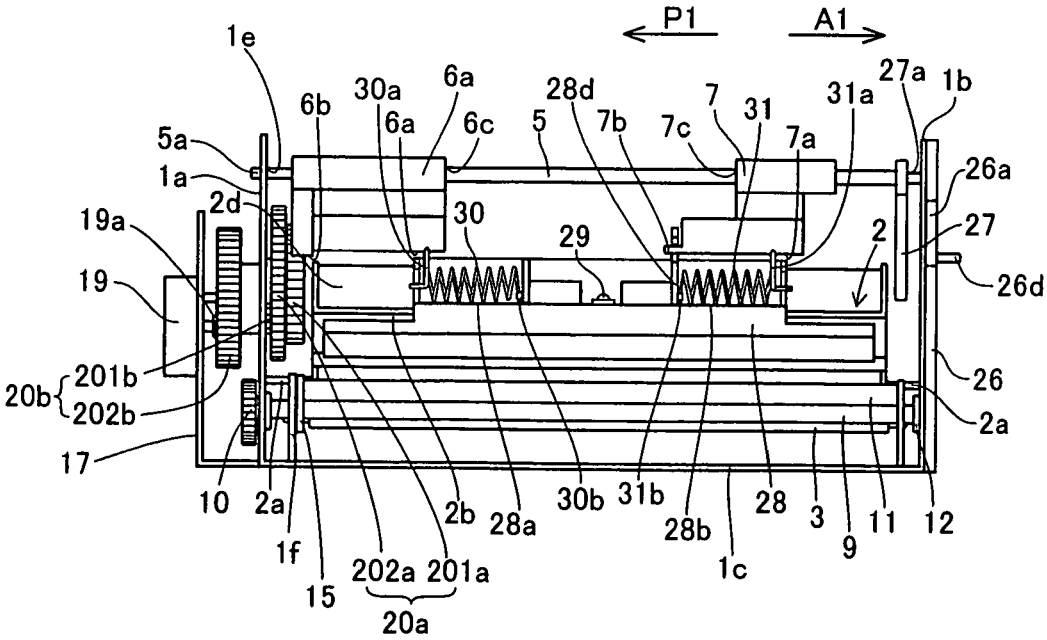
FIG. 2 is a front elevational view of the thermal transfer printer according to the embodiment shown in FIG. 1.
Figure 3:
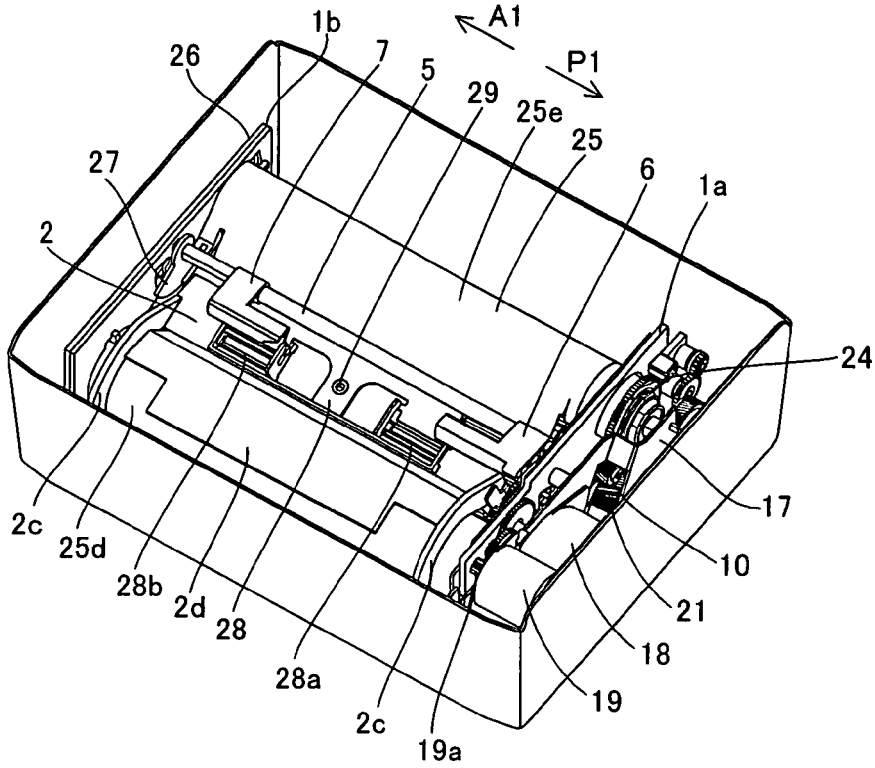
FIG. 3 is a perspective view of the thermal transfer printer according to the embodiment shown in FIG. 1, mounted with an ink sheet cartridge.

As shown in FIGS. 1 and 2, a spring holder 28 is fixed to the upper surface of the heat sink portion 2*d* of the print head 2 with a screw 29. This spring holder 28 is provided with two spring fixing portions 28*a* and 28*b* mounted with two torsion coil springs 30 and 31 respectively. The torsion coil spring 30 has a first end 30*a* pressed against the press portion 6*a* of the head portion press member 6 upon downward rotation of the head portion press member 6 and a second end 30*b* transmitting urging force resulting from the pressed first end 30*a* to the head portion 2*b*. The torsion coil spring 31 also has a first end 31*a* pressed against the press portion 7*a* of the head portion press member 7 upon downward rotation of the head portion press member 7 and a second end 31*b* transmitting urging force resulting from the pressed first end 31*a* to the head portion 2*b*. The head portion 2*b* is pressed against the platen roller 3 due to the urging force of the torsion coil springs 30 and 31 transmitted thereto.

As shown in FIGS. 1 and 13, the spring fixing portion 28*b* of the spring holder 28 is integrally formed with an engaging portion 28*d* having a notch 28*c* engaging with the projection 7*b* of the head portion press member 7. When the head portion press member 7 upwardly rotates, therefore, the projection 7*b* of the head portion press member 7 and the notch 28*c* of the spring fixing portion 28*b* engage with each other, thereby upwardly rotating the head portion 2*b*. Consequently, the head portion 2*b* having been pressed against the platen roller 3 (see FIG. 1) separates from the platen roller 3 upon rotation of the head portion press member 7.

The feed roller bearings 12 and 13 rotatably support the feed roller 9 of metal, as shown in FIG. 2. The feed roller 9 is provided on a first end thereof with a feed roller gear insert portion 9*a* (see FIG. 4) inserted into the feed roller gear 10. The press roller bearings 14 rotatably support the press roller 11 of metal, as shown in FIG. 2. The press roller bearings 14 are mounted on the bearing support plates 15 provided inside the bent section if provided on the bottom surface 1*c* of the chassis 1 and the second side surface 1*b* thereof respectively. As shown in FIG. 1, the bearing support plates 15 are provided inside the bent section 1*f* provided on the bottom surface 1*c* of the chassis 1 and the second side surface 1*b* thereof respectively, to be rotatable about support portions 15*a*. Second ends of the helical tension springs 16 for urging the press roller 11 toward the feed roller 9 are mounted on spring mount portions 15*b* of the bearing support plates 15.

Figure 5:
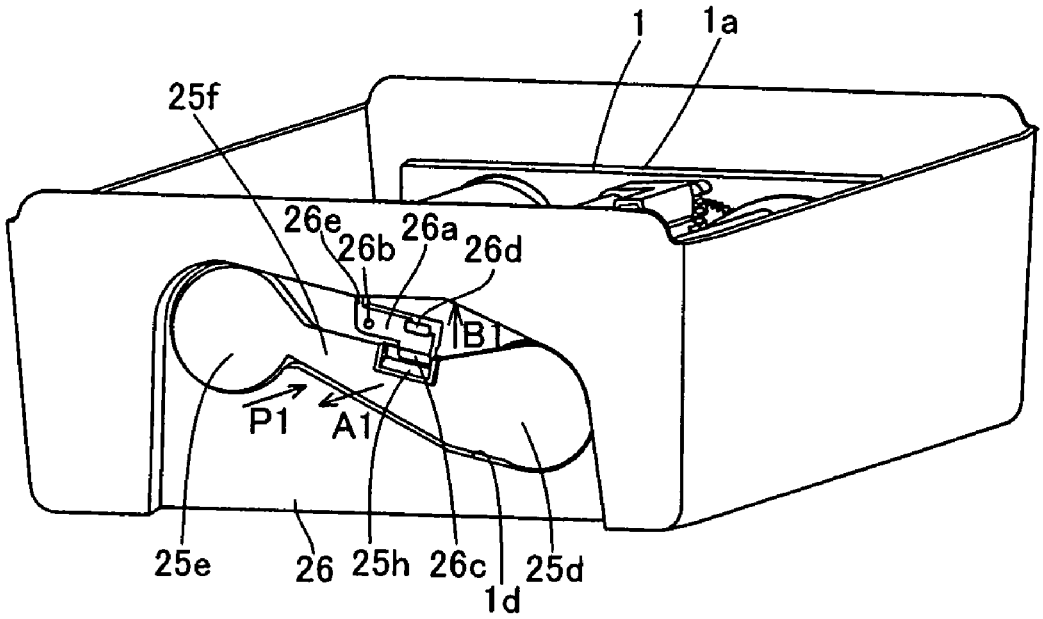
FIG. 5 is a perspective view of the thermal transfer printer according to the embodiment shown in FIG. 1, mounted with the ink sheet cartridge.
Figure 9:
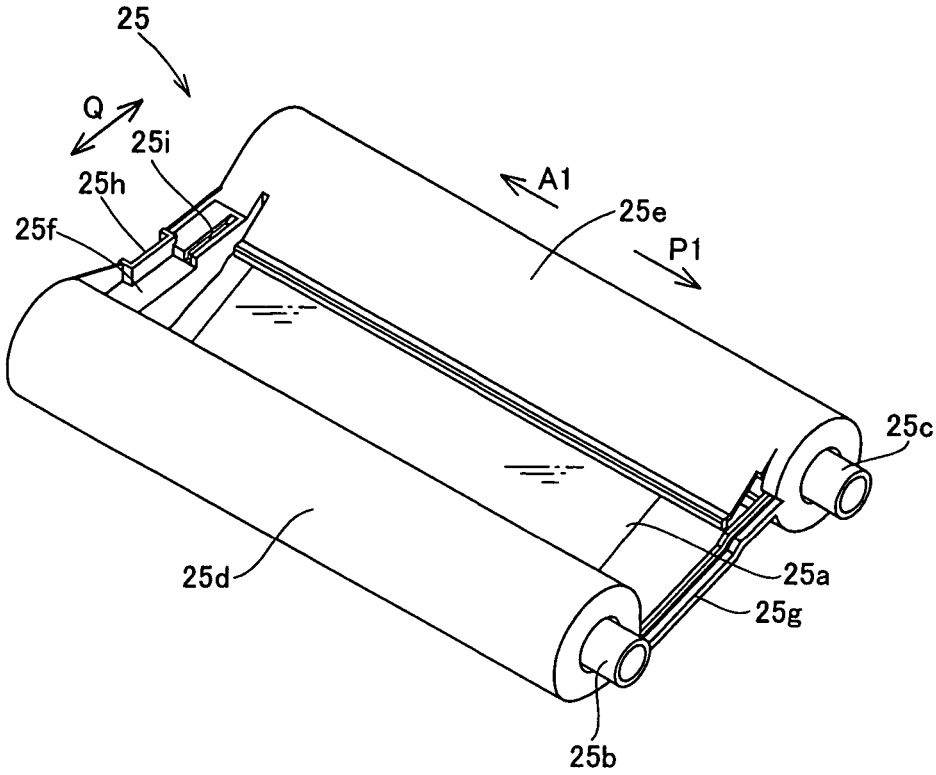
FIG. 9 is an overall perspective view of the ink sheet cartridge mounted on the thermal transfer printer according to the embodiment shown in FIG. 1.
Figure 10:
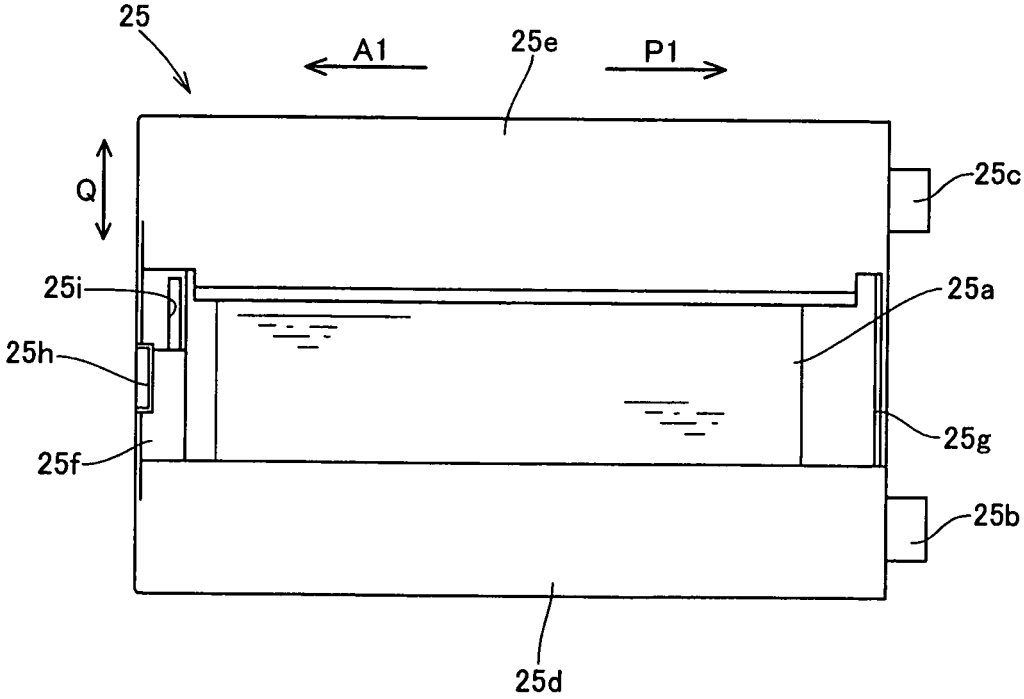
FIG. 10 is a plan view of the ink sheet cartridge mounted on the thermal transfer printer according to the embodiment shown in FIG. 1.
Figure 11:
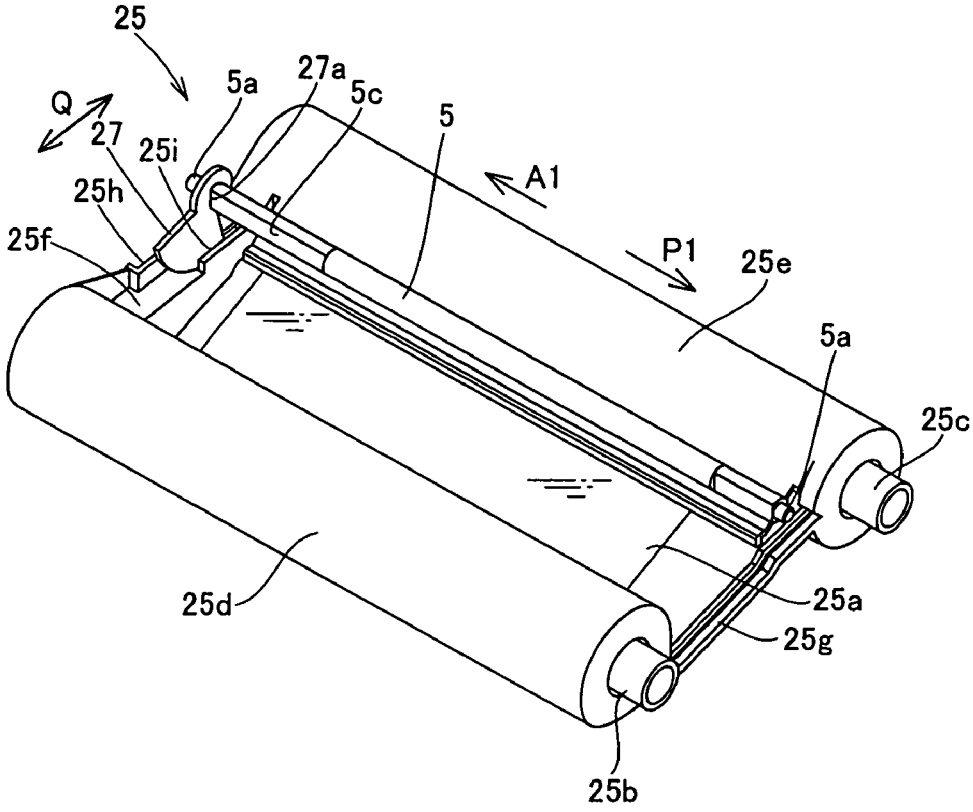
FIG. 11 is another overall perspective view of the ink sheet cartridge mounted on the thermal transfer printer according to the embodiment shown in FIG. 1.
Figure 12:
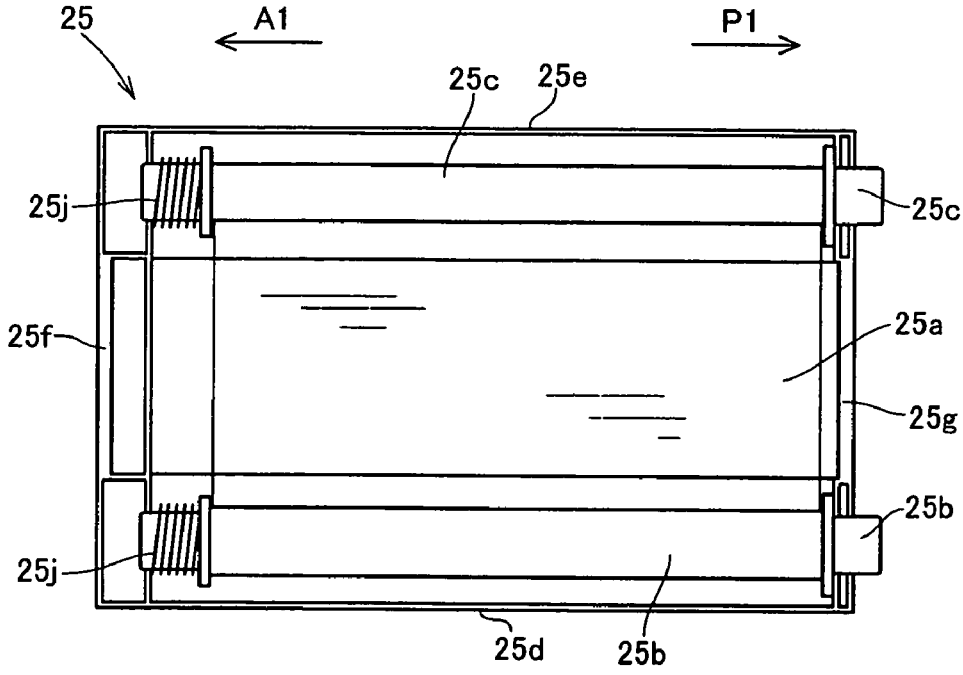
FIG. 12 is a plan view showing the internal structure of the ink sheet cartridge mounted on the thermal transfer printer according to the embodiment shown in FIG. 1.

As shown in FIG. 12, the ink sheet cartridge 25 includes a feed bobbin 25*b* for feeding the ink sheets 25*a* and a take-up bobbin 25*c* for taking up the fed ink sheets 25*a*. A cartridge case forming the ink sheet cartridge 25 is constituted of a feed bobbin storage portion 25*d* rotatably storing the feed bobbin 25*b*, a take-up bobbin storage portion 25*e* rotatably storing the take-up bobbin 25*c* and a pair of coupling portions 25*f* and 25*g* coupling the feed bobbin storage portion 25*d* and the take-up bobbin storage portion 25*e* with each other at a prescribed distance, as shown in FIGS. 9 to 11. When the feed bobbin storage portion 25*d* and the take-up bobbin storage portion 25*e* store the feed bobbin 25*b* and the take-up bobbin 25*c* respectively, therefore, the ink sheets 25*a* wound on the feed bobbin 25*b* and the take-up bobbin 25*c* are outwardly exposed on the space of the prescribed distance between the feed bobbin storage portion 25*d* and the take-up bobbin storage portion 25*e*. The ink sheets 25*a* are constituted of those of three colors, i.e., Y (yellow), M (magenta) and C (cyan) ink sheets 25*a*. As shown in FIGS. 5 and 9, the coupling portion 25*f* is provided with the engaging portion 25*h* engaging with the stop member 27 provided on the first side surface 1*a* of the chassis 1. As shown in FIG. 12, the ink sheet cartridge 25 is provided with helical compression springs 25*j* regularly urging the ink sheet cartridge 25 mounted on the thermal transfer printer in the ejective direction along arrow A1 in FIG. 5.

According to this embodiment, a slender groove portion (engaging portion) 25*i* is provided on the upper surface of the coupling portion 25*f* of the ink sheet cartridge 25 for engaging with the stop member 27, as shown in FIGS. 9 and 10. This groove portion 25*i* extends parallelly to the extensional direction (along arrow Q in FIG. 10) of the coupling portion 25*f*. The width of the groove portion 25*i* is rendered slightly larger than the thickness of the stop member 27. When the stop member 27 is inserted into the groove portion 25*i*, therefore, the groove portion 25*i* engages with both surfaces of the stop member 27 as shown in FIG. 11.

Figure 4:
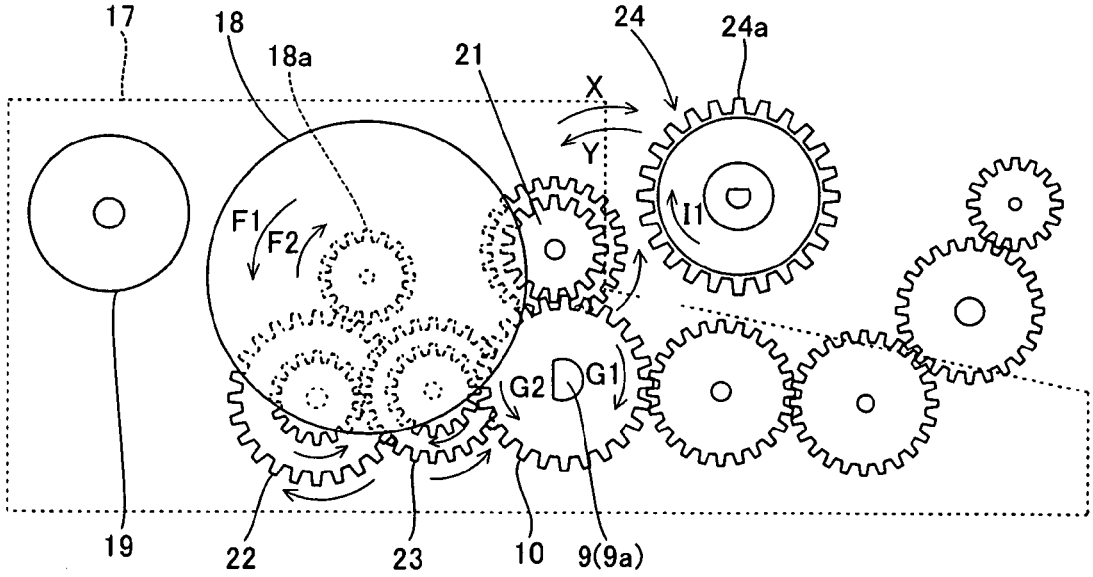
FIG. 4 is a front elevational view showing a stepping motor and respective gears of the thermal transfer printer according to the embodiment shown in FIG. 1.

The take-up reel 24 (see FIG. 4) engages with the take-up bobbin 25*c* arranged in the take-up bobbin storage portion 25*e* of the ink sheet cartridge 25 (see FIG. 9), thereby taking up the ink sheets 25*a* wound on the take-up bobbin 25. As shown in FIG. 4, the gear portion 24*a* of the take-up reel 24 meshes with the swing gear 21 swinging along arrow X.

As shown in FIG. 4, further, the paper feed motor 18 driving the feed roller 9 and the take-up reel 24 is mounted on the motor bracket 17 through the motor gear 18*a* and the intermediate gears 22 and 23. The press member rotating motor 19 vertically rotating the head portion press members 6 and 7 is mounted on the motor bracket 17. A small-diametral gear portion 201*a* of the drive gear 20*a* meshes with the gear portion 6*b* of the head portion press member 6 as shown in FIG. 2, while a large-diametral gear portion 202*a* thereof meshes with a small-diametral gear 201*b* of the intermediate gear 20*b* as shown in FIG. 1. A large-diametral gear 202*b* of the intermediate gear 20*b* meshes with the motor gear 19*a* of the press member rotating motor 19. Thus, driving of the press member rotating motor 19 is transmitted to the head portion press member 6 through the intermediate gear 20*b* and the drive gear 20*a*.

A printing operation of the thermal transfer printer according to this embodiment is now described with reference to FIGS. 1, 2, 4, 5 and 13 to 18.

In an initial state, the thermal transfer printer holds the head portion 2*b* of the print head 2 at a position separated from the platen roller 3, as shown in FIG. 13. At this time, the projection 7*b* of the head portion press member 7 engages with the notch 28*c* of the engaging portion 28*d* of the spring fixing portion 28*b* provided on the head portion 2*b*, thereby inhibiting the head portion 2*b* from rotation along arrow D1 in FIG. 13. The thermal transfer printer regularly urges the ink sheet cartridge 25 along arrow A1 in FIG. 5, and inhibits the same from movement along arrow A1 due to the engagement between the engaging portion 25*h* of the ink sheet cartridge 25 and the engaging pawl 26*c* of the stop portion 26*a*, as shown in FIG. 5.

Figure 14:
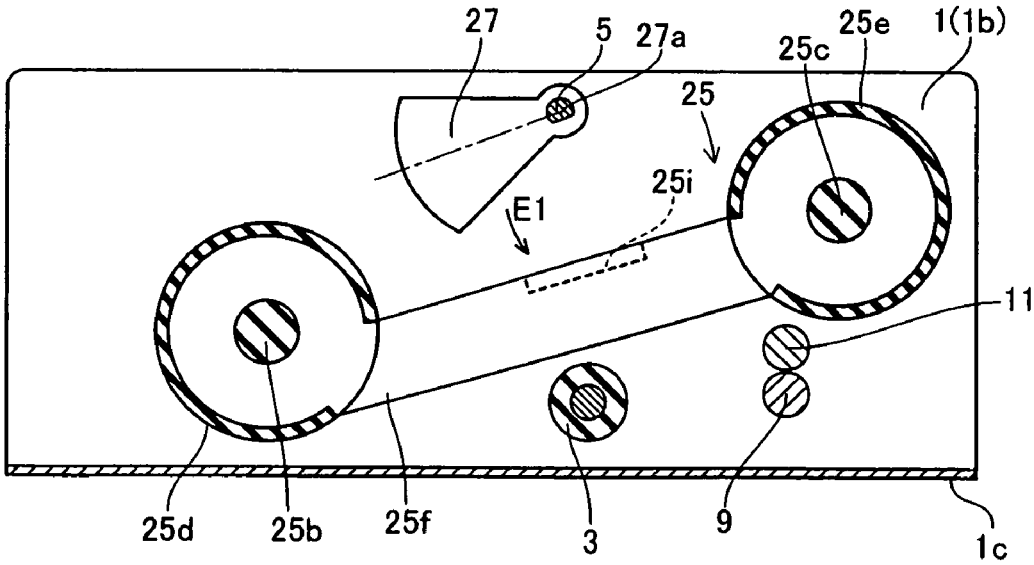
FIGS. 14 to 18 are sectional views for illustrating a printing operation of the thermal transfer printer according to the embodiment shown in FIG. 1.

When the thermal transfer printer drives the press member rotating motor 19 (see FIG. 4) from the initial state shown in FIG. 13, the driving force thereof is transmitted to the gear portion 6*a* of the head portion press member 6 through the intermediate gear 20*b* (see FIG. 2) and the drive gear 20*a*, thereby rotating the head portion press member 6 about the support rod 5 along arrow E1. At this time, the head portion press member 7 also rotates along arrow E1 with the head portion press member 6, since the head portion press members 6 and 7 (see FIG. 2) do not idle with respect to the support rod 5. The projection 7*b* of the head portion press member 7 so rotates along arrow E1 that the head portion 2*b*, having been controlled through the projection 7*b* not to rotate along arrow D1, also rotates along arrow D1. Thus, the head portion 2*b* moves toward the platen roller 3 (press side), as shown in FIG. 13. The stop member 27 also rotates along arrow E1 following the rotation of the head portion press members 6 and 7, as shown in FIG. 14.

Figure 15:
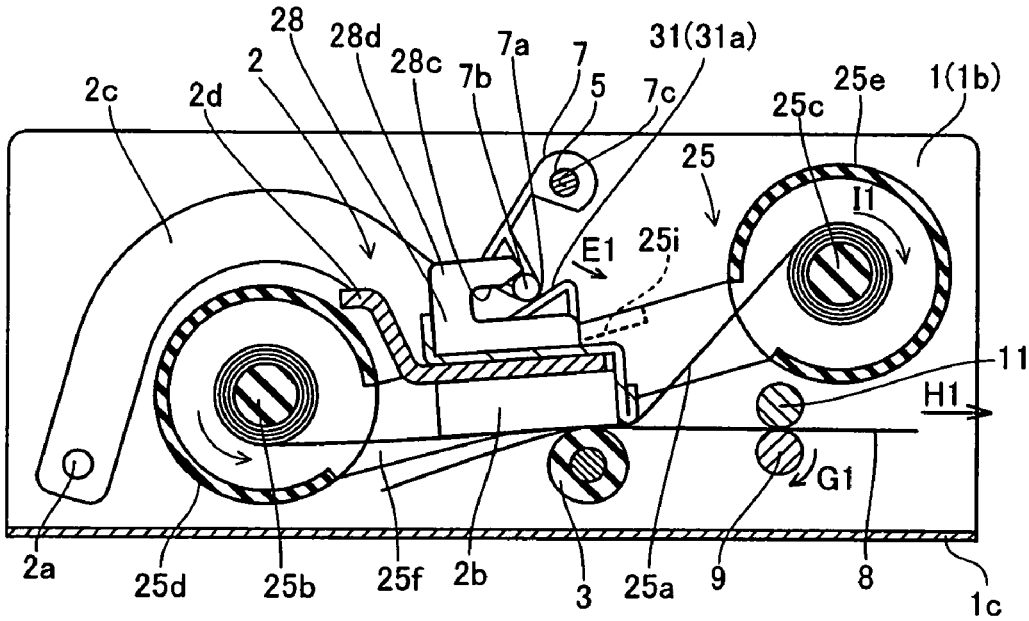

While the print head 2 moves to a press position shown in FIG. 15, the head portion press members 6 and 7 further rotate along arrow E1. Thus, the press portion 6*a* of the head portion press member 6 presses the first end 30*a* of the torsion coil spring 30 arranged on the spring holder 28. Further, the press portion 7*a* of the head portion press member 7 also presses the first end 31*a* of the torsion coil spring 31 arranged on the spring holder 28. At this time, the torsion coil springs 30 and 31 cause urging force, which in turn is transmitted to the head portion 2*b* through the second ends 30*b* and 31*b* of the torsion coil springs 30 and 31 respectively. Thus, the head portion 2*b* is urged toward the platen roller 30 through the paper 8 and the Y ink sheet 25*a*. The head portion 2*b* generates heat, to melt ink of the Y ink sheet 25*a* and transfer the same to the paper 8.

As shown in FIG. 4, the thermal transfer printer drives the paper feed motor 18 to rotate the motor gear 18*a* mounted thereon along arrow F1, thereby rotating the feed roller gear 10 along arrow G1 through the intermediate gears 22 and 23. Thus, the feed roller 9 rotates along arrow G1 following the rotation of the feed roller gear 10 (see FIG. 4) as shown in FIG. 15, thereby carrying the paper 8 in a paper discharge direction (along arrow H1 in FIG. 15). The swingable swing gear 21 (see FIG. 4) swings along arrow X in FIG. 4, to mesh with the gear portion 24*a* of the take-up reel 24. Therefore, the gear portion 24*a* of the take-up reel 24 rotates along arrow I1 in FIG. 4, so that the take-up bobbin 25*c* takes up the Y ink sheet wound on the feed bobbin 25*b*. Thus, the ink is continuously transferred from the Y ink sheet 25*a* to the paper 8.

Figure 16:
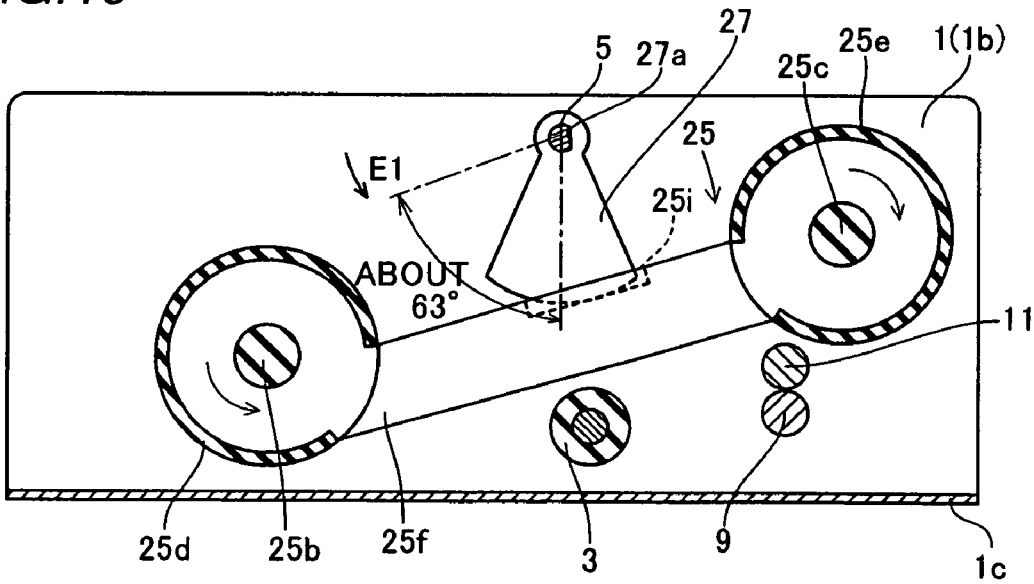

As shown in FIG. 16, the stop member 27 rotates along arrow E1 by about 63° from the initial position of the print head 2 following the rotation of the head portion press members 6 and 7. In this state, the core of the stop member 27 is perpendicular. In printing, the stop member 27 engages with the groove portion 25*i* of the ink sheet cartridge 25, as shown in FIG. 16.

According to this embodiment, the thermal transfer printer inhibits the ink sheet cartridge 25 from movement in the ejective direction (along arrow A1 in FIG. 5) not only through the stop portion 26*a* provided outside the second side surface 1*b* of the chassis 1 but also through the stop member 27 provided inside the second side surface 1*b* of the chassis 1, due to the engagement between the stop member 27 and the groove portion 25*i* of the ink sheet cartridge 25. Also when the user manually operates the stop portion 26*a* provided outside the second side surface 1*b* of the chassis 1 for ejecting the ink sheet cartridge 25, therefore, the thermal transfer printer inhibits the ink sheet cartridge 25 from movement in the ejective direction (along arrow A1 in FIG. 5) due to the engagement between the stop member 27 provided inside the second side surface 1*b* of the chassis 1 and the groove portion 25*i* of the ink sheet cartridge 25.

Figure 17:
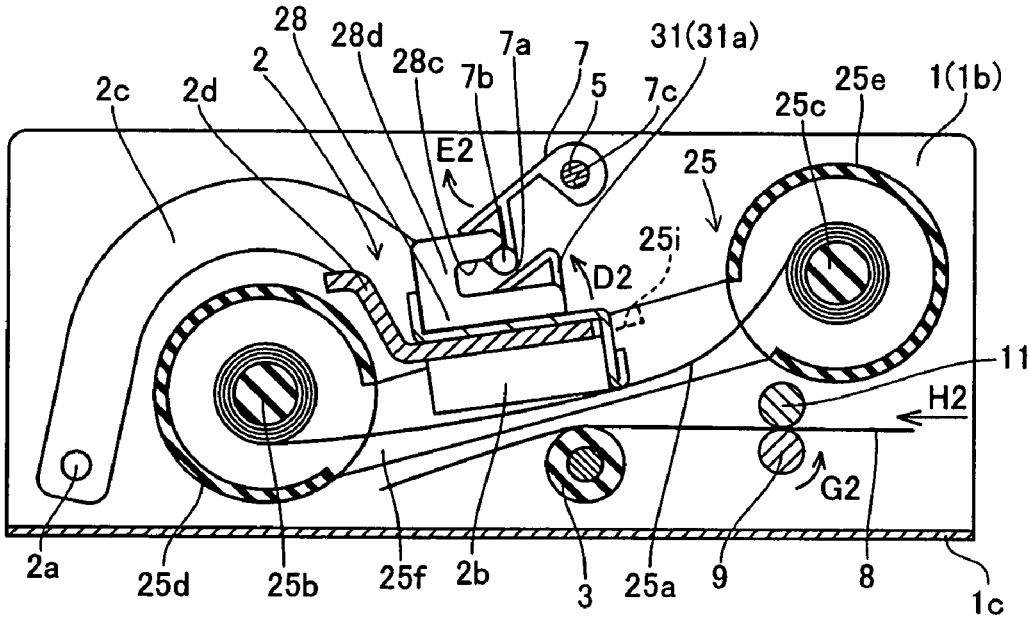
Figure 18:
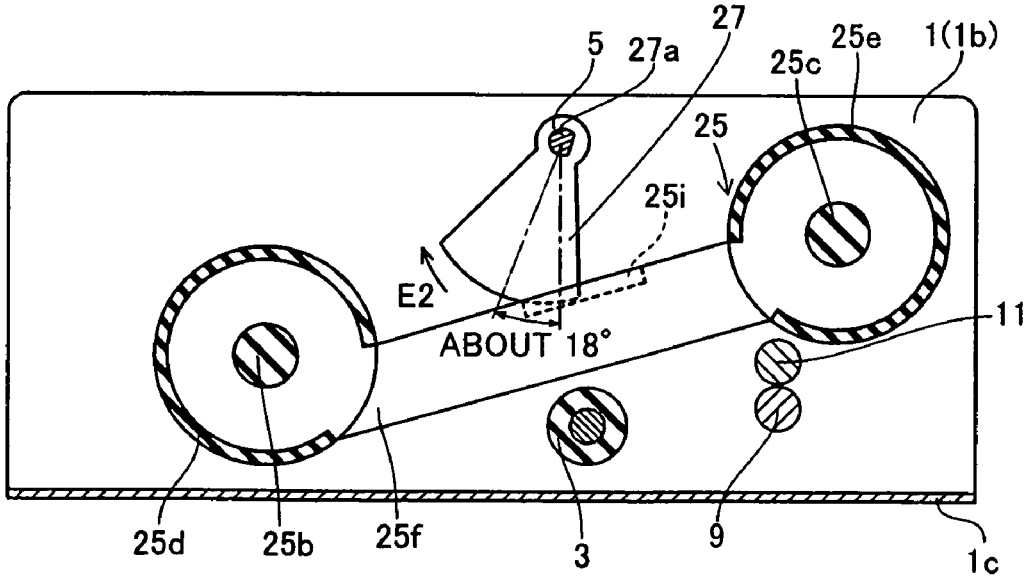
Figure 19:
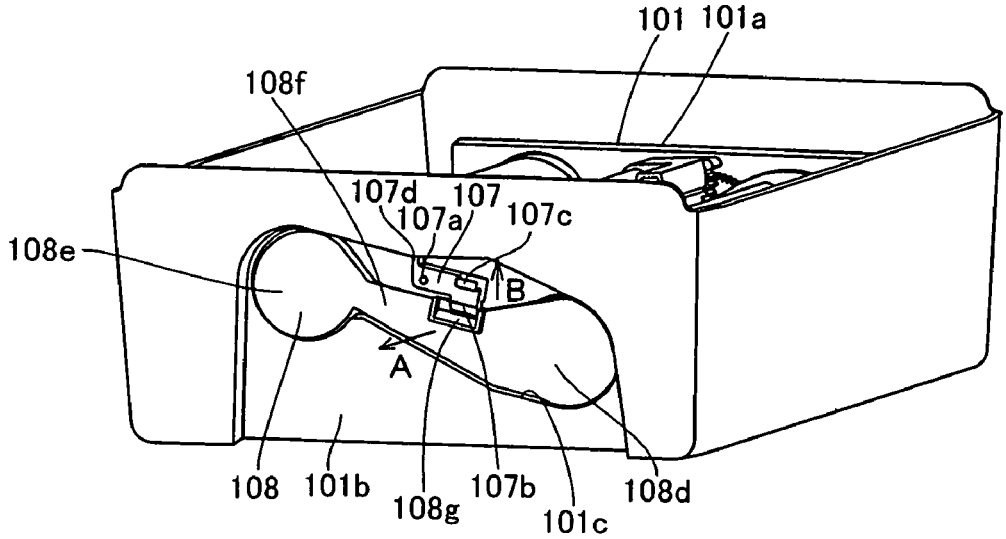
FIG.19 PRIOR ART
FIG. 19 is an overall perspective view of an exemplary conventional thermal transfer printer, mounted with an ink sheet cartridge.
Figure 20:
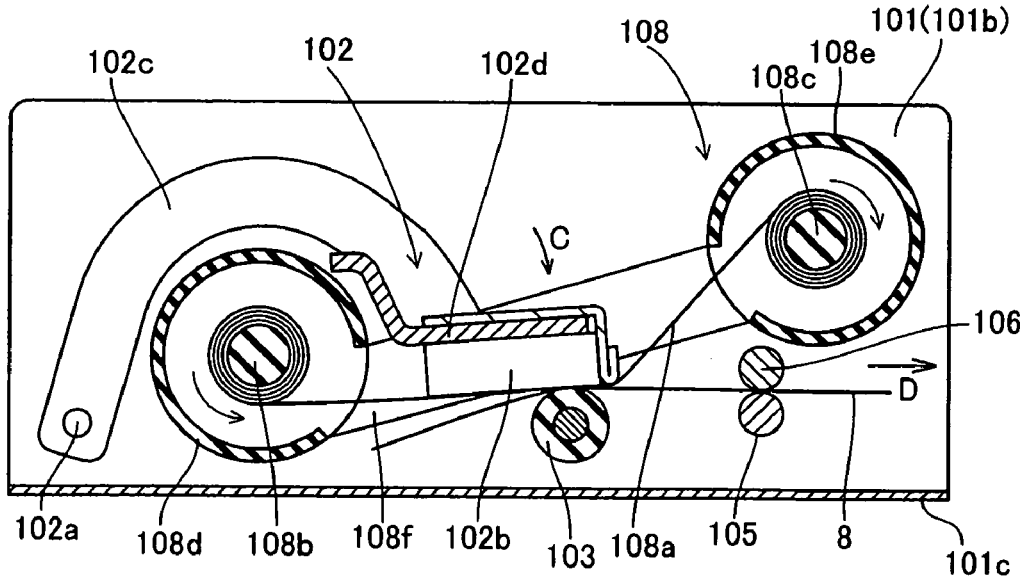
FIG.20 PRIOR ART
FIG. 20 is a sectional view of the exemplary conventional thermal transfer printer shown in FIG. 19.

Upon completion of printing of the Y (yellow) ink sheet 25*a*, the thermal transfer printer drives the press member rotating motor 19 (see FIG. 4) so that the driving force thereof is transmitted to the gear portion 6*a* of the head portion press member 6 through the intermediate gear 20*b* (see FIG. 1) and the drive gear 20*a*. Thus, the head portion press member 6 rotates about the support rod 5 along arrow E2 in FIG. 17. At this time, the head portion press member 7 also rotates along arrow E2 as shown in FIG. 17, since the head portion press members 6 and 7 (see FIG. 2) do not idle with respect to the support rod 5. The projection 7*b* of the head portion press member 7 rotates along arrow E2 to lift up the notch 28*c* of the spring holder 28 of the print head 2 engaging with the projection 7*b*, thereby rotating the head portion 2*b* of the print head 2 along arrow D2. Thus, the head portion 2*b* of the print head 2 separates from the platen roller 3. As shown in FIG. 18, the stop member 27 rotates along arrow E2 by about 18° following the rotation of the head portion press members 6 and 7. According to this embodiment, the stop member 27 is still in engagement with the slender groove portion 25*i* after the head portion 2*b* of the print head 2 separates from the platen roller 3.

As shown in FIG. 4, the thermal transfer printer drives the paper feed motor 18 to rotate the motor gear 18*a* mounted thereon along arrow F2, thereby rotating the feed roller gear 10 along arrow G2 through the intermediate gears 22 and 23. Thus, the feed roller 9 rotates along arrow G2 following the rotation of the feed roller gear 10 (see FIG. 4) as shown in FIG. 17, thereby carrying the paper 8 in a paper feed direction (along arrow H2 in FIG. 17) again. The swingable swing gear 21 (see FIG. 4) swings along arrow Y in FIG. 4, to separate from the gear portion 24*a* of the take-up reel 24. Thus, the thermal transfer printer carries only the paper 8 in the paper feed direction without taking up the Y ink sheet 25*a* wound on the feed bobbin 25*b* on the take-up bobbin 25*c*.

Thereafter the thermal transfer printer performs operations similar to the above on the M and C ink sheets 25*a*. When completely printing the Y, M and C ink sheets 25*a*, the thermal transfer printer carries the paper 8 in the paper discharge direction (along arrow H1 in FIG. 13). Then, the head portion 2*b* of the print head 2*b* rotates to the initial position as shown in FIG. 13, thereby completing printing on the paper 8. When the head portion 2*b* of the print head 2 is on the initial position, the stop member 27 and the groove portion 25*i* of the ink sheet cartridge 25 are in disengagement from each other, and only the stop portion 26*a* inhibits the ink sheet cartridge 25 from movement in the ejective direction (along arrow A1 in FIG. 5).

According to this embodiment, as hereinabove described, the stop portion 26*a* is provided outside the chassis 1 while the stop member 27 engaging with the ink sheet cartridge 25 in printing is provided inside the chassis 1 so that the stop member 27 and the ink sheet cartridge 25 remain engaging with each other in the chassis 1 also when the user disengages the stop portion 26*a* provided outside the chassis 1 and the ink sheet cartridge 25 from each other in printing, whereby the thermal transfer printer can suppress ejection of the ink sheet cartridge 25 in printing. Consequently, the thermal transfer printer can suppress breakage of the ink sheets 25*a*, and can prevent a failure resulting from entanglement of the ink sheets 25*a* therein.

According to this embodiment, the stop member 27 is so provided inside the chassis 1 that the user can be inhibited from touching the stop member 27, whereby the thermal transfer printer can prevent the second stop member 27 from application of a load in printing. Thus, the thermal transfer printer can prevent the members provided inside the chassis 1 from application of a load in printing, thereby suppressing reduction of printing quality.

According to this embodiment, the stop member 27 is mounted on the support rod 5 to be rotatable following rotation of the head portion press members 6 and 7 rotating the print head 2 in printing, whereby the stop member 27 can engage with the ink sheet cartridge 25 in printing without a dedicated drive source. Consequently, the thermal transfer printer can easily suppress ejection of the ink sheet cartridge 25 in printing.

According to this embodiment, the ink sheet cartridge 25 is provided with the groove portion 25*i* engaging with both surfaces of the stop member 27, whereby the thermal transfer printer can inhibit the ink sheet cartridge 25 from movement not only in the ejective direction (along arrow A1 in FIG. 2) but also in a direction (along arrow P1 in FIG. 2) opposite thereto. Thus, the thermal transfer printer can suppress reduction of printing quality resulting from misregistration in the direction (along arrow P1 in FIG. 2) opposite to the ejective direction for the ink sheets 25*a*.

According to this embodiment, the stop member 27 rotates following rotation of the print head 2 to engage with the groove portion 25*i* when the print head 2 vertically rotates for printing the ink sheets 25*a* of a plurality of colors, whereby the thermal transfer printer can suppress ejection of the ink sheet cartridge 25 also when the user disengages the stop portion 26*a* and the ink sheet cartridge 25 from each other while the print head 2 separates from the platen roller 3 upon completion of printing in each color. Thus, the thermal transfer printer can suppress imperfect completion of printing resulting from ejection of the ink sheet cartridge 25 in an intermediate stage of printing in each color.

According to this embodiment, the groove portion 25*i* provide on the coupling portion 25*f* of the ink sheet cartridge 25 is so located around a central portion between the take-up bobbin storage portion 25*e* and the feed bobbin storage portion 25*d* that the stop portion 27 can engage with the groove portion 25*i* around the central portion between the take-up bobbin storage portion 25*e* and the feed bobbin storage portion 25*d*. Therefore, the stop member 27 can inhibit the ink sheet cartridge 25 from movement around the central portion between the take-up bobbin storage portion 25*e* and the feed bobbin storage portion 25*d* of the ink sheet cartridge 25, whereby the thermal transfer printer can more stably inhibit the ink sheet cartridge 25 from movement as compared with a case of inhibiting the ink sheet cartridge 25 from movement on the side of the feed bobbin storage portion 25*d* or the take-up bobbin storage portion 25*e*.

According to this embodiment, the portion of the stop member 27 engaging with the ink sheet cartridge 25 is arcuately formed, whereby the stop member 27 can so easily partially engage with the engaging portion 25*i* that the thermal transfer printer can easily keep the stop member 27 and the groove portion 25*i* in engagement also when the print head 2 vertically rotates in printing.

According to this embodiment, the groove portion 25*i* of the ink sheet cartridge 25 has a slender form, whereby the thermal transfer printer can so increase the area of the groove portion 25*i* engaging with the stop member 27 as to inhibit the stop member 27 from disengaging from the slender groove portion 25*i* when the print head 2 rotates to separate from the platen roller 3 upon completion of printing in each color. Thus, the thermal transfer printer can easily engage the stop member 27 with the groove portion 25*i* also when the print head 2 separates from the platen roller 3 upon completion of printing in each color.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the thermal transfer printer, the present invention is not restricted to this but is also applicable to another image generating apparatus other than the thermal transfer printer.

While the groove portion is provided on one of the coupling portions of the ink sheet cartridge in the aforementioned embodiment, the present invention is not restricted to this but the groove portion may alternatively be provided on a position other than the coupling portion of the ink sheet cartridge. For example, the groove portion may be provided on the take-up bobbin storage portion.

While the groove portion engaging with the stop member is provided on one of the coupling portions of the ink sheet cartridge in the aforementioned embodiment, the present invention is not restricted to this but an engaging portion other than the groove portion may alternatively be provided on the ink sheet cartridge so far as the same can engage with the stop member for inhibiting the ink sheet cartridge from movement in the ejective direction. For example, a boss engaging with the stop member may be provided on the ink sheet cartridge. Further, the stop member may be provided in the form of a groove, and the ink sheet cartridge may be formed with a projecting portion engaging with the groove-shaped stop member.

While the angle of the arcuately formed portion of the stop member is set to about 40° in the aforementioned embodiment, the present invention is not restricted to this but the arcuately formed portion of the stop member may alternatively be at an angle other than 40°.

While the thermal transfer printer is provided with the arcuate stop member in the aforementioned embodiment, the present invention is not restricted to this but the thermal transfer printer may alternatively be provided with a stop member having a shape other than the arcuate shape so far as the same can engage with the ink sheet cartridge.

What is claimed is:

1. An image generating apparatus comprising:

an ink sheet cartridge including a cartridge case provided with a feed bobbin storage portion and a take-up bobbin storage portion coupled with each other through a pair of coupling portions at a prescribed interval, a feed bobbin and a take-up bobbin stored in said cartridge case and an ink sheet outwardly exposed between said feed bobbin storage portion and said take-up bobbin storage portion;

a chassis mounted with said ink sheet cartridge; a print head for printing; a platen roller arranged on a position opposite to said print head; a press member pressing said print head against said platen roller;

a first stop member provided outside said chassis for engaging with said ink sheet cartridge; and a second stop member provided inside said chassis for engaging with said ink sheet cartridge in printing wherein said ink sheet cartridge is provided with an engaging portion engaging with said second stop member, wherein the first stop member and the second stop member are provided independently of each other and wherein each of the first and second stop members is configured to engage directly with the ink sheet cartridge, wherein the first stop member and the second stop member are each configured to inhibit movement of the ink sheet cartridge in a direction opposite to a direction for insertion of the ink sheet cartridge into the image generating apparatus, and wherein said second stop member is mounted on a rotating shaft of said press member.

2. The image generating apparatus according to claim 1, wherein said second stop member is unidly mounted with respect to said rotating shaft.

3. The image generating apparatus according to claim 2, wherein an oval stop member insert portion is provided on a portion of said rotating shaft mounted with said second stop member, and an oval rotating shaft receiving hole is provided on a portion of said second stop member receiving said rotating shaft.

4. The image generating apparatus according to claim 1, wherein said engaging portion of said ink sheet cartridge includes a groove portion engaging with both surfaces of said second stop member.

5. The image generating apparatus according to claim 4, wherein said ink sheet cartridge further includes multicolor said ink sheet, and said second stop member rotates following rotation of said print head, and engages with said groove portion while said print head vertically rotates for printing said multicolor ink sheet.

6. The image generating apparatus according to claim 5, wherein said groove portion has a slender shape.

7. The image generating apparatus according to claim 4, wherein said groove portion is provided on either said coupling portion of said ink sheet cartridge.

8. The image generating apparatus according to claim 1, wherein a portion of said second stop member engaging with said engaging portion of said ink sheet cartridge is arcuately formed.

9. An image generating apparatus comprising:

an ink sheet cartridge including a cartridge case provided with a feed bobbin storage portion and a take-up bobbin storage portion coupled with each other through a pair of coupling portions at a prescribed interval, a feed bobbin and a take-up bobbin stored in said cartridge case and a multicolor ink sheet outwardly exposed between said feed bobbin storage portion and said take-up bobbin storage portion;

a chassis mounted with said ink sheet cartridge;

a print head for printing;

a platen roller arranged on a position opposite to said print head;

a press member pressing said print head against said platen roller;

a first stop member provided outside said chassis for engaging with said ink sheet cartridge; and a second stop member provided inside said chassis for engaging with said ink sheet cartridge in printing, wherein said ink sheet cartridge is provided with a groove portion engaging with both surfaces of said second stop member, said groove portion is provided on either said coupling portion of said ink sheet cartridge;

said second stop member is mounted on a rotating shaft of said press member for rotating following rotation of said print head and engaging with said groove portion while said print head vertically rotates for printing said multicolor ink sheet, and a portion of said second stop member engaging with said ink sheet cartridge is arcuately formed.

10. The image generating apparatus according to claim 9, wherein said second stop member is unidly mounted with respect to said rotating shaft.

11. The image generating apparatus according to claim 10, wherein an oval stop member insert portion is provided on a portion of said rotating shaft mounted with said second stop member, and an oval rotating shaft receiving hole is provided on a portion of said second stop member receiving said rotating shaft.

12. The image generating apparatus according to claim 9, wherein said groove portion has a slender shape.

* * * * *